US011291922B2

(12) United States Patent
Vansot

(10) Patent No.: US 11,291,922 B2
(45) Date of Patent: Apr. 5, 2022

(54) HEATED STUFFED ANIMAL ASSEMBLY

(71) Applicant: Abdulkarrim Vansot, Lacey, WA (US)

(72) Inventor: Abdulkarrim Vansot, Lacey, WA (US)

( * ) Notice: Subject to any disclaimer, the term of this patent is extended or adjusted under 35 U.S.C. 154(b) by 0 days.

(21) Appl. No.: 16/996,378

(22) Filed: Aug. 18, 2020

(65) Prior Publication Data

US 2022/0054950 A1 Feb. 24, 2022

(51) Int. Cl.

| | |
|---|---|
| ***A63H 3/02*** | (2006.01) |
| ***A63H 3/36*** | (2006.01) |
| ***A63H 3/00*** | (2006.01) |
| ***H05B 3/56*** | (2006.01) |
| ***H05B 1/02*** | (2006.01) |

(52) U.S. Cl.

CPC ..... *A63H 3/003* (2013.01); *A63H 3/006* (2013.01); *A63H 3/02* (2013.01); *H05B 1/0272* (2013.01); *H05B 3/56* (2013.01)

(58) Field of Classification Search

CPC ..... A63H 3/003; A63H 3/006; A63H 3/02; A63H 3/36; H05B 1/0272; H05B 3/56

USPC ..... 446/369, 484; 219/200, 201

See application file for complete search history.

(56) References Cited

U.S. PATENT DOCUMENTS 1,558,278 A * 10/1925 Phillips ..... A61F 7/007 383/96
1,896,663 A * 2/1933 Collins ..... H05B 3/342 219/478
2,647,195 A * 7/1953 Broyles ..... A63H 3/001 219/473
2,774,184 A * 12/1956 Hefferan ..... A63H 3/001 446/295
4,204,110 A * 5/1980 Smit ..... A61F 7/08 215/217
4,714,445 A * 12/1987 Templeton ..... A61F 7/02 446/369
4,954,676 A * 9/1990 Rankin ..... A61F 7/007 219/200
4,979,923 A * 12/1990 Tanaka ..... A61F 7/007 219/201
5,906,763 A * 5/1999 Warren Van Deventer Wheeler ..... A47J 36/24 219/386
6,019,659 A * 2/2000 Walters ..... A61F 7/007 219/200
6,139,394 A * 10/2000 Maxim ..... A63H 3/006 446/219
6,325,695 B1 * 12/2001 Weiner ..... A61F 7/007 446/295
6,488,561 B2 * 12/2002 Weiner ..... A61F 7/007 219/201

(Continued)

*Primary Examiner* — Alexander R Niconovich

(57) ABSTRACT

A heated stuffed animal assembly for warming a user that is holding a stuffed animal includes a stuffed animal that has a body, a pair of arms, a pair of legs, a head and pair of ears. A heating element is integrated into the stuffed animal and the heating element is in thermal communication with the stuffed animal. Moreover, the heating element heats the stuffed animal to warm the user when the user holds the stuffed animal. The heating element comprises a plurality of heating coils that are distributed over the body, each of the arms and each of the legs. A control is coupled to the stuffed animal such that the control is accessible to the user. The control is electrically coupled to the heating element for turning the heating element on and off.

5 Claims, 4 Drawing Sheets

(56) References Cited

U.S. PATENT DOCUMENTS

| | | | | |
|---|---|---|---|---|
| 6,752,103 | B1 * | 6/2004 | Howell | A01K 9/00 119/71 |
| D525,365 | S * | 7/2006 | Mills | A61F 7/08 D21/604 |
| 7,241,196 | B1 * | 7/2007 | Nikliborc | A61F 7/007 446/295 |
| 7,435,153 | B1 * | 10/2008 | Sodec, Jr. | A47F 8/00 446/295 |
| 7,883,391 | B1 * | 2/2011 | Asomani | A61J 9/0638 446/28 |
| 8,414,347 | B2 * | 4/2013 | Achan, Jr | A63H 3/02 446/178 |
| 8,801,490 | B2 * | 8/2014 | Achan, Jr. | A63H 3/02 446/72 |
| 9,089,782 | B2 * | 7/2015 | Achan, Jr. | A63H 3/02 |
| 2002/0023917 | A1 * | 2/2002 | Hall-Grace | H05B 3/34 219/528 |
| 2005/0101220 | A1 * | 5/2005 | Jackson | A63H 3/003 446/369 |
| 2010/0056017 | A1 * | 3/2010 | Kyse | A63H 3/003 446/369 |
| 2012/0255941 | A1 * | 10/2012 | Skarzynski | A63H 3/02 219/201 |

* cited by examiner

HEATED STUFFED ANIMAL ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to stuffed animal devices and more particularly pertains to a new stuffed animal device for warming a user that is holding a stuffed animal.

(2) Description of Related Art Including Information Disclosed Under 37 CFR 1.97 and 1.98

The prior art relates to stuffed animal devices including a stuffed animal with a singular heat storage mass integrated into the stuffed animal for warming the stuffed animal. The prior art discloses a stuffed animal with a transient phase material that transitions to a liquid phase when the material is heated and subsequently transitions to a solid phase when the heat is released into the stuffed animal. The prior art discloses a stuffed animal with a heating coil being integrated therein for heating the stuffed animal. The prior art discloses a variety of stuffed animals that have light emitters coupled thereto for emitting light. The prior art discloses a variety of stuffed animals that has a cavity therein and a heating element being positioned within the cavity for heating the stuffed animal.

(h) BRIEF SUMMARY OF THE INVENTION

An embodiment of the disclosure meets the needs presented above by generally comprising a stuffed animal that has a body, a pair of arms, a pair of legs, a head and pair of ears. A heating element is integrated into the stuffed animal and the heating element is in thermal communication with the stuffed animal. Moreover, the heating element heats the stuffed animal to warm the user when the user holds the stuffed animal. The heating element comprises a plurality of heating coils that are distributed over the body, each of the arms and each of the legs. A control is coupled to the stuffed animal such that the control is accessible to the user. The control is electrically coupled to the heating element for turning the heating element on and off.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
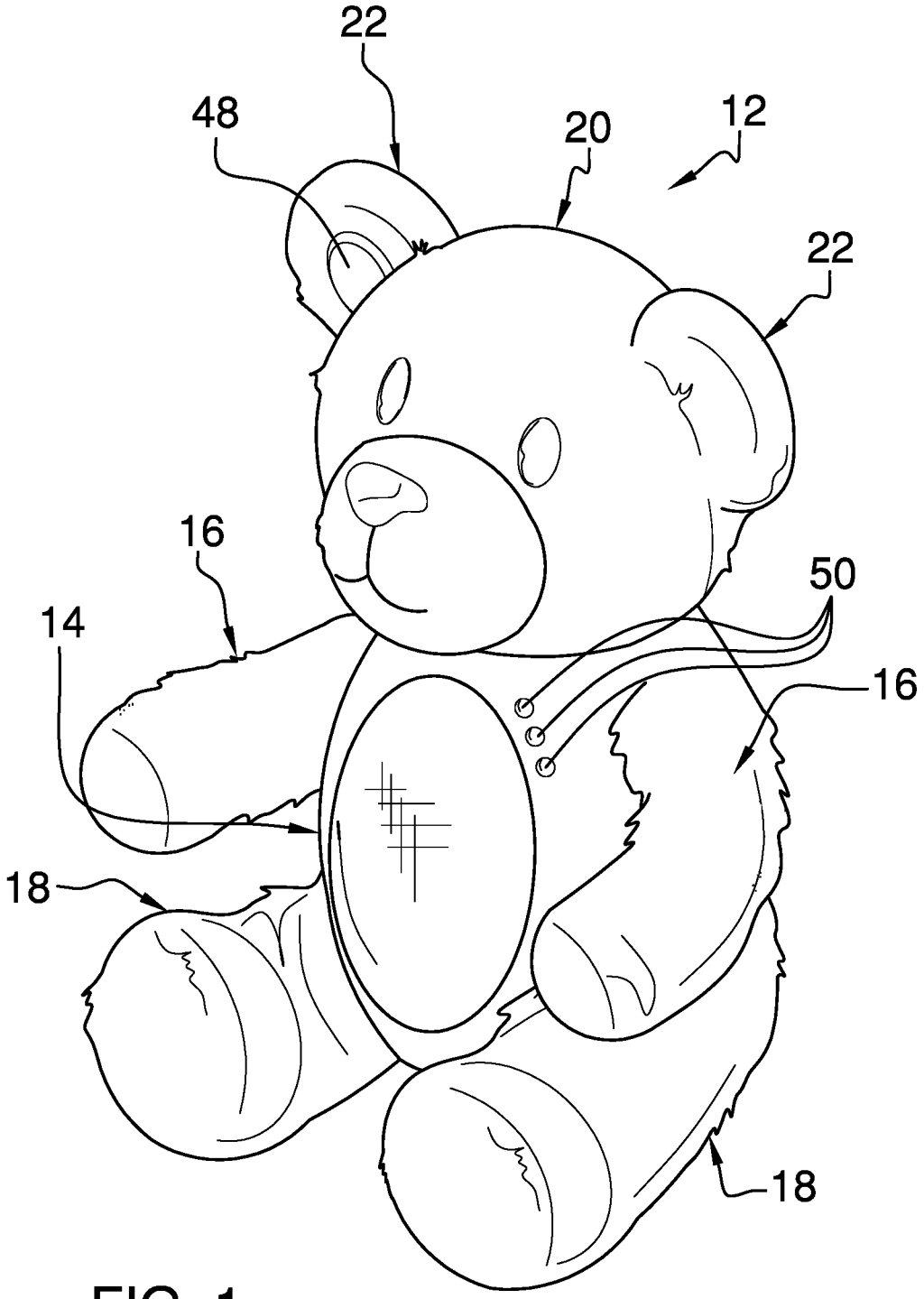
FIG. 1 is a front perspective view of a heated stuffed animal assembly according to an embodiment of the disclosure.
Figure 2:
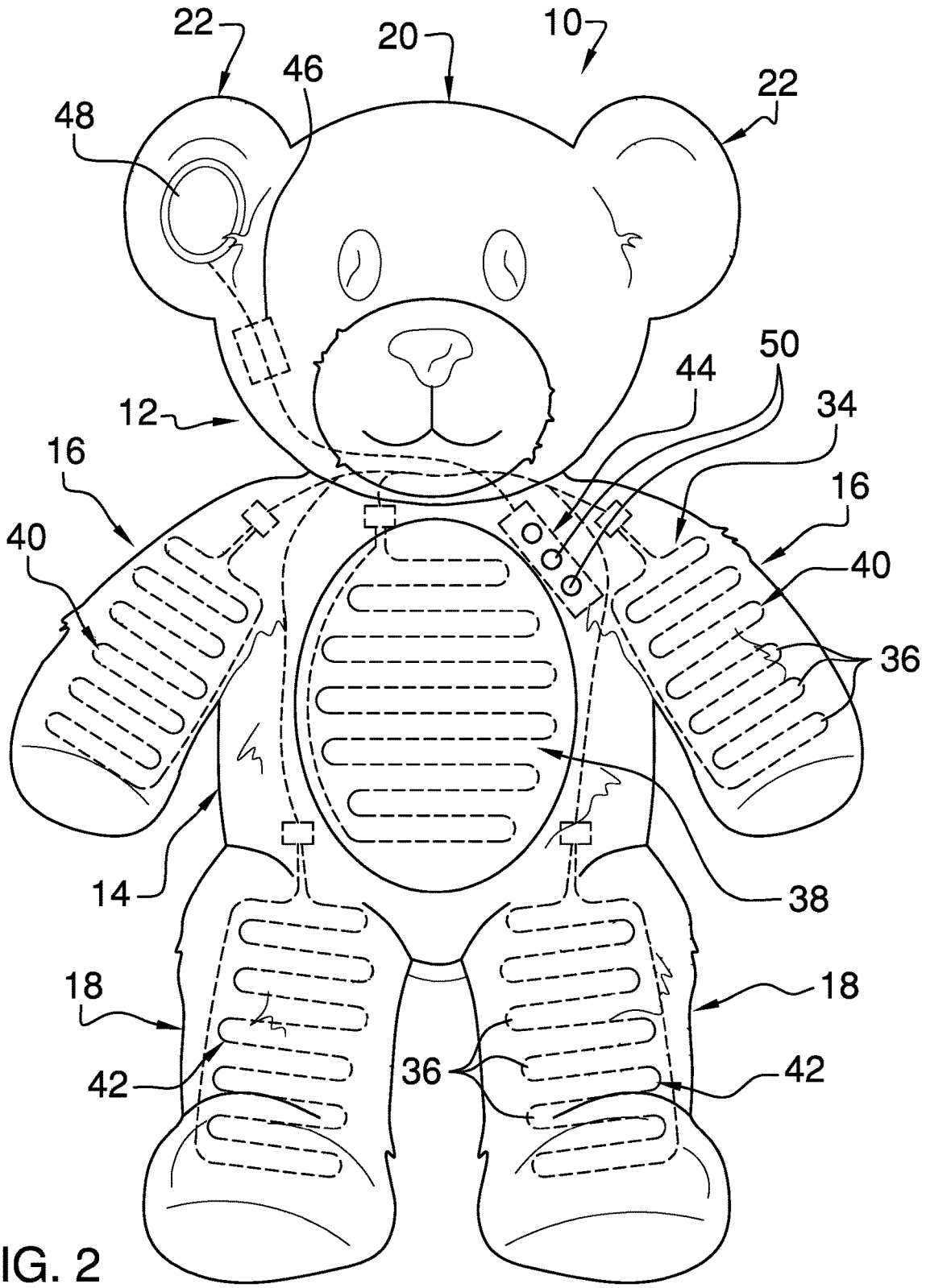
FIG. 2 is a front phantom view of an embodiment of the disclosure.
Figure 3:
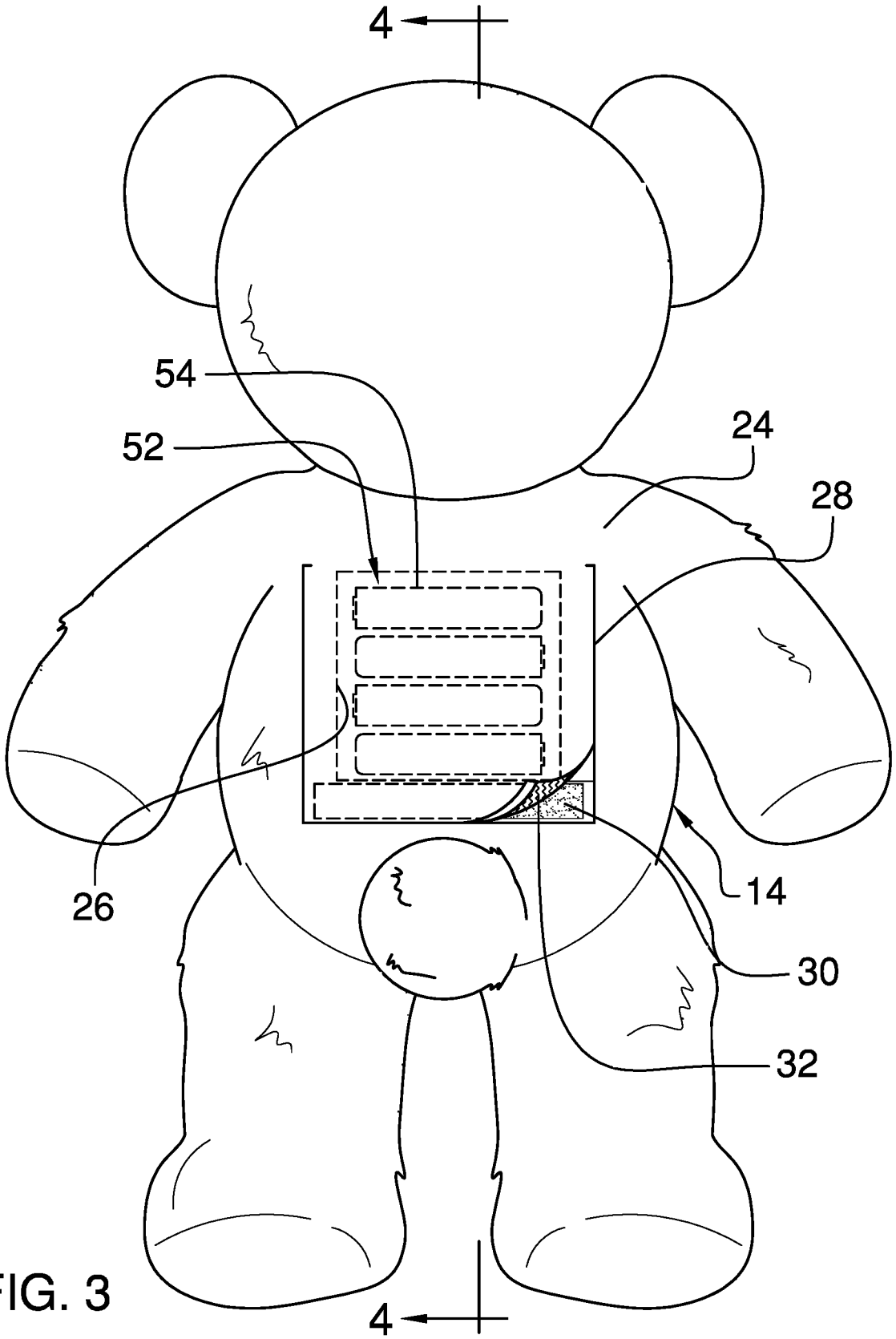
FIG. 3 is a back phantom view of an embodiment of the disclosure.
Figure 4:
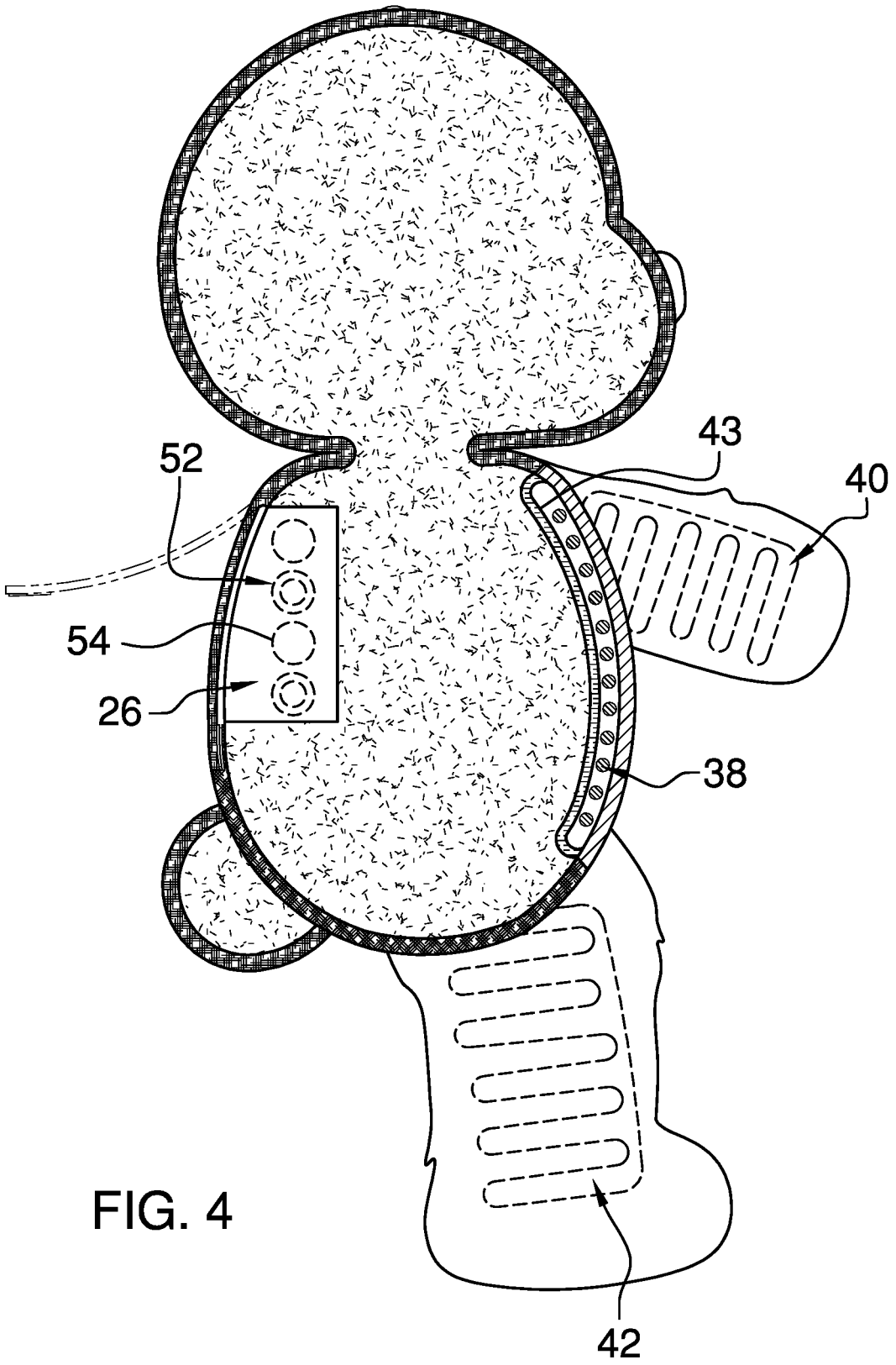
FIG. 4 is a cross sectional view taken along line 4-4 of FIG. 3 of an embodiment of the disclosure.

With reference now to the drawings, and in particular to FIGS. 1 through 4 thereof, a new stuffed animal device embodying the principles and concepts of an embodiment of the disclosure and generally designated by the reference numeral 10 will be described.

As best illustrated in FIGS. 1 through 4, the heated stuffed animal assembly 10 generally comprises a stuffed animal 12 that has a body 14, a pair of arms 16, a pair of legs 18, a head 20 and pair of ears 22. The body 14 has a back side 24, and the back side 24 has a well 26 extending inwardly therein. A flap 28 is coupled to the back side 24 of the body 14 and the flap 28 is aligned with the well 26 for covering and un-covering the well 26. A first mating member 30 is coupled to the back side 24 of the body 14 and a second mating member 32 is coupled to the flap 28. The second mating member 32 releasably engages the first mating member 30 when the flap 28 covers the well 26 for retaining the flap 28 over the well 26. Each of the first mating member 30 and the second mating member 32 may comprise a hook and loop fastener or other similar, releasable fastener.

A heating element 34 is provided and the heating element 34 is integrated into the stuffed animal 12. Moreover, the heating element 34 is in thermal communication with the stuffed animal 12. The heating element 34 is heated when the heating element 34 is turned on thereby heating the stuffed animal 12. In this way the stuffed animal 12 can warm the user when the user holds the stuffed animal 12. The heating element 34 comprises a plurality of heating coils 36 that includes a set of body coils 38, sets of arm coils 40 and sets of leg coils 42. The body coils 38 are distributed over the body 14, each of the arm coils 40 is distributed over a respective one of the arms 16 and each of the leg coils 42 is distributed over a respective one of the legs 18. Each of the heating coils 36 may comprise electric heating coils that have a maximum operational temperature of approximately 120.0 degrees Fahrenheit. As is most clearly shown in FIG. 4, an insulating layer 43 may be positioned behind each of the heating coils 38 to inhibit the heating coils 38 from heating a center of the stuffed animal 12, thereby enhancing warmth felt by the user.

A control 44 is provided and the control 44 is coupled to the stuffed animal 12 such that the control 44 is accessible to the user. The control 44 is electrically coupled to the heating element 34 for turning the heating element 34 on and off. The control 44 comprises a control circuit 46 that is integrated into the stuffed animal 12 and the control circuit 46 is electrically coupled to the heating element 34. The control 44 includes a button 48 that is movably positioned on a respective one of the ears 22 of the stuffed animal 12 to be depressed by the user and the button 48 is electrically coupled to the control circuit 46. The button 48 actuates the heating element 34 between a minimum heat, a medium heat and a high heat depending on the number of times the button 48 is depressed. Moreover, the button 48 turns the heating element 34 off when the button 48 is depressed a required number of times.

The control 44 includes a plurality of light emitters 50 is provided and each of the light emitters 50 is coupled to the stuffed animal 12 to emit light outwardly therefrom. Each of the light emitters 50 is electrically coupled to the control circuit 46. Additionally, each of the light emitters 50 is individually turned on in accordance with the heating element 34 being actuated to the minimum heat, the medium heat or the maximum heat. Each of the light emitters 50 may comprise an LED or the like and each of the light emitters 50 may emit a unique color of light with respect to each other. The control 44 includes a power supply 52 that is positioned in the well 26 in the back side 24 of the body 14, the power supply 52 is electrically coupled to the control circuit 46 and the power supply 52 comprises at least one battery 54.

In use, the button 48 is depressed once for low heat, twice for medium heat, three times for high heat or four times to turn off the heating element 34. In this way the stuffed animal 12 produces heat at a desired intensity that facilitates the user to be warmed when the user hugs the stuffed animal 12. Thus, the user can be kept warm when the user has an illness or any other time that the user wishes to keep warm. The flap 28 is opened to remove and replace the at least one battery 54 when the at least one battery 54 becomes depleted.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A heated stuffed animal assembly for warming a user, said assembly comprising:

a stuffed animal having a body, a pair of arms, a pair of legs, a head and pair of ears;

a heating element being integrated into said stuffed animal, said heating element being in thermal communication with said stuffed animal, said heating element being heated when said heating element is turned on thereby heating said stuffed animal wherein said stuffed animal is configured to warm the user when the user holds said stuffed animal, said heating element comprising a plurality of heating coils, said plurality of heating coils including a set of body coils, a pair of arm coils and a pair of leg coils, said body coils being distributed over said body, each of said arm coils being distributed over a respective one of said arms, each of said leg coils being distributed over a respective one of said legs;

a control being coupled to said stuffed animal wherein said control is configured to be accessible to the user, said control being electrically coupled to said heating element for turning said heating element on and off;

wherein said body has a back side, said back side having a well extending inwardly therein;

wherein said assembly includes a flap being coupled to said back side of said body, said flap being aligned with said well for covering and un-covering said well;

wherein said assembly includes a first mating member being coupled to said back side of said body;

wherein said assembly includes a second mating member being coupled to said flap, said second mating member releasably engaging said first mating member when said flap covers said well for retaining said flap over said well; and wherein said control comprises a button being movably positioned on a respective one of said ears of said stuffed animal wherein said button is configured to be depressed by the user, said button being electrically coupled to said control circuit, said button actuating said heating element between a minimum heat, a medium heat and a high heat depending on the number of times said button is depressed, said button turning said heating element off when said button is depressed a required number of times.

2. The assembly according to claim 1, wherein said control comprises a control circuit being integrated into said stuffed animal, said control circuit being electrically coupled to said heating element.

3. The assembly according to claim 1, wherein said control comprises a plurality of light emitters, each of said light emitters being coupled to said stuffed animal wherein each of said light emitters is configured to emit light outwardly therefrom, each of said light emitters being electrically coupled to said control circuit, each of said light emitters being individually turned on in accordance with said heating element being actuated to said minimum heat, said medium heat or said maximum heat.

4. The assembly according to claim 1, wherein said control comprises:

a control circuit being integrated into said stuffed animal; and a power supply being positioned in said well in said back side of said body, said power supply being electrically coupled to said control circuit, said power supply comprising at least one battery.

5. A heated stuffed animal assembly for warming a user, said assembly comprising:

a stuffed animal having a body, a pair of arms, a pair of legs, a head and pair of ears, said body having a back side, said back side having a well extending inwardly therein;

a flap being coupled to said back side of said body, said flap being aligned with said well for covering and un-covering said well;

a first mating member being coupled to said back side of said body;

a second mating member being coupled to said flap, said second mating member releasably engaging said first mating member when said flap covers said well for retaining said flap over said well;

a heating element being integrated into said stuffed animal, said heating element being in thermal communication with said stuffed animal, said heating element being heated when said heating element is turned on thereby heating said stuffed animal wherein said stuffed animal is configured to warm the user when the user holds said stuffed animal, said heating element comprising a plurality of heating coils, said plurality of heating coils including a set of body coils, a pair of arm coils and a pair of leg coils, said body coils being distributed over said body, each of said arm coils being distributed over a respective one of said arms, each of said leg coils being distributed over a respective one of said legs;

a control being coupled to said stuffed animal wherein said control is configured to be accessible to the user, said control being electrically coupled to said heating element for turning said heating element on and off, said control comprising:

a control circuit being integrated into said stuffed animal, said control circuit being electrically coupled to said heating element;

a button being movably positioned on a respective one of said ears of said stuffed animal wherein said button is configured to be depressed by the user, said button being electrically coupled to said control circuit, said button actuating said heating element between a minimum heat, a medium heat and a high heat depending on the number of times said button is depressed, said button turning said heating element off when said button is depressed a required number of times;

a plurality of light emitters, each of said light emitters being coupled to said stuffed animal wherein each of said light emitters is configured to emit light outwardly therefrom, each of said light emitters being electrically coupled to said control circuit, each of said light emitters being individually turned on in accordance with said heating element being actuated to said minimum heat, said medium heat or said maximum heat; and a power supply being positioned in said well in said back side of said body, said power supply being electrically coupled to said control circuit, said power supply comprising at least one battery.

* * * * *